US011125436B2

(12) United States Patent
Baranowicz et al.

(10) Patent No.: US 11,125,436 B2
(45) Date of Patent: Sep. 21, 2021

(54) COMBUSTOR FLOATING COLLAR MOUNTING ARRANGEMENT

(71) Applicant: PRATT & WHITNEY CANADA CORP., Longueuil (CA)

(72) Inventors: Maximilian Baranowicz, Brampton (CA); Si-Man Amy Lao, Mississauga (CA); Oleg Morenko, Oakville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 155 days.

(21) Appl. No.: 16/502,886

(22) Filed: Jul. 3, 2019

(65) Prior Publication Data

US 2021/0003283 A1 Jan. 7, 2021

(51) Int. Cl.

| | |
|---|---|
| ***F23R 3/60*** | (2006.01) |
| ***F23R 3/28*** | (2006.01) |
| ***F23R 3/00*** | (2006.01) |
| ***F23R 3/42*** | (2006.01) |
| *F23R 3/34* | (2006.01) |

(52) U.S. Cl.

CPC ..... *F23R 3/283* (2013.01); *F23R 3/002* (2013.01); *F23R 3/42* (2013.01); *F23R 3/60* (2013.01); *F23R 3/346* (2013.01); *F23R 2900/00012* (2013.01); *F23R 2900/00016* (2013.01); *F23R 2900/00017* (2013.01); *F23R 2900/03044* (2013.01)

(58) Field of Classification Search

None

See application file for complete search history.

(56) References Cited

U.S. PATENT DOCUMENTS

| | | | | |
|---|---|---|---|---|
| 4,365,470 | A | 12/1982 | Matthews et al. | |
| 5,996,335 | A * | 12/1999 | Ebel | F23R 3/50 60/740 |
| 6,412,272 | B1 * | 7/2002 | Titterton, III | F23R 3/283 60/39.37 |
| 8,015,706 | B2 | 9/2011 | Markarian et al. | |
| 2002/0038549 | A1 * | 4/2002 | Ebel | F23R 3/10 60/748 |
| 2003/0131474 | A1 | 7/2003 | Kastrup et al. | |

(Continued)

FOREIGN PATENT DOCUMENTS

| | | | |
|---|---|---|---|
| CA | 2936577 | A1 | 6/2017 |

OTHER PUBLICATIONS

European Search Report issued in counterpart application No. 20183556.8 dated Oct. 9, 2020.

*Primary Examiner* — Todd E Manahan
*Assistant Examiner* — Alyson Joan Harrington
(74) *Attorney, Agent, or Firm* — Norton Rose Fulbrigh Canada LLP

(57) ABSTRACT

A floating collar assembly is configured to receive a fuel nozzle or an igniter projecting through an opening defined in a combustor shell lined with heat shields having studs projecting through the combustor shell for engagement with corresponding fasteners outside the combustor shell. A floating collar is mounted outside the combustor shell with an opening in alignment with the opening in the combustor shell for receiving the fuel nozzle or the igniter. An external retaining bracket is mounted to the heat shield studs or other studs projecting outwardly from the combustor shell so as to trap the floating collar between the combustor shell and the bracket.

8 Claims, 3 Drawing Sheets

(56) References Cited

U.S. PATENT DOCUMENTS

| | | | | |
|---|---|---|---|---|
| 2006/0042268 | A1 | 3/2006 | Markarian et al. | |
| 2008/0016874 | A1* | 1/2008 | Markarian | F23R 3/002 60/772 |
| 2013/0055716 | A1 | 3/2013 | Gerendas | |

* cited by examiner

COMBUSTOR FLOATING COLLAR MOUNTING ARRANGEMENT

TECHNICAL FIELD

The disclosure relates generally to gas turbine engine combustors and, more particularly, to a floating collar therefor.

BACKGROUND ART

Gas turbine combustors are typically provided with floating collars or seal assemblies for mounting igniters or fuel nozzles to the combustor, in order to facilitate relative movement of igniters or fuel nozzles with controlled leakage therebetween during engine operation. Conventional floating collar configurations include the floating collar being trapped between a heat shield and combustor liner or the floating collar being encased in a fabricated boss assembly that is permanently attached to the combustor liner. Such configurations may cause an increase in durability issues or an increase in part costs due to multiple piece retaining assemblies and required joining operations. There is, thus, a need for alternative floating collar mounting arrangements.

SUMMARY

In one aspect, there is provided a floating collar assembly for receiving a fuel nozzle or an igniter, the floating collar assembly comprising: a floating collar configured for mounting outside the combustor shell and having an opening configured and sized for alignment with an opening in the combustor shell for receiving the fuel nozzle or the igniter, and a retaining bracket configured for mounting to studs extending outwardly of the combustor shell, the floating collar configured to be trapped between the combustor shell or other external structure and the retaining bracket when the bracket is mounted to the combustor shell.

In another aspect, there is provided a gas turbine engine combustor comprising: a combustor having a combustor shell circumscribing a combustion chamber, the combustor shell having a dome defining at least one nozzle opening for receiving a fuel nozzle, heat shields lining an inner surface of the dome, the heat shields having studs projecting through the combustor shell for engagement with corresponding fasteners outside the combustor shell, and at least one floating collar retained in position outside the dome of the combustor shell by a retaining bracket mounted to some of the studs of the heat shields and secured in position by the fasteners, the at least one floating collar being trapped between the dome of the combustor shell or other external structure and the retaining bracket.

In a further aspect, there is provided a method of mounting a floating collar to a combustor shell of a combustor of a gas turbine engine, the combustor shell having an inner surface lined with heat shields having studs projecting through the combustor shell for engagement with fasteners outside of the combustor shell, the method comprising: aligning the floating collar with a corresponding opening in the combustor shell, and securing a retaining bracket to at least some of the studs of the heat shields, the floating collar being trapped between the combustor shell or other external structure and the retaining bracket.

DESCRIPTION OF THE DRAWINGS

Reference is now made to the accompanying Figures in which.

DETAILED DESCRIPTION

Figure 1:
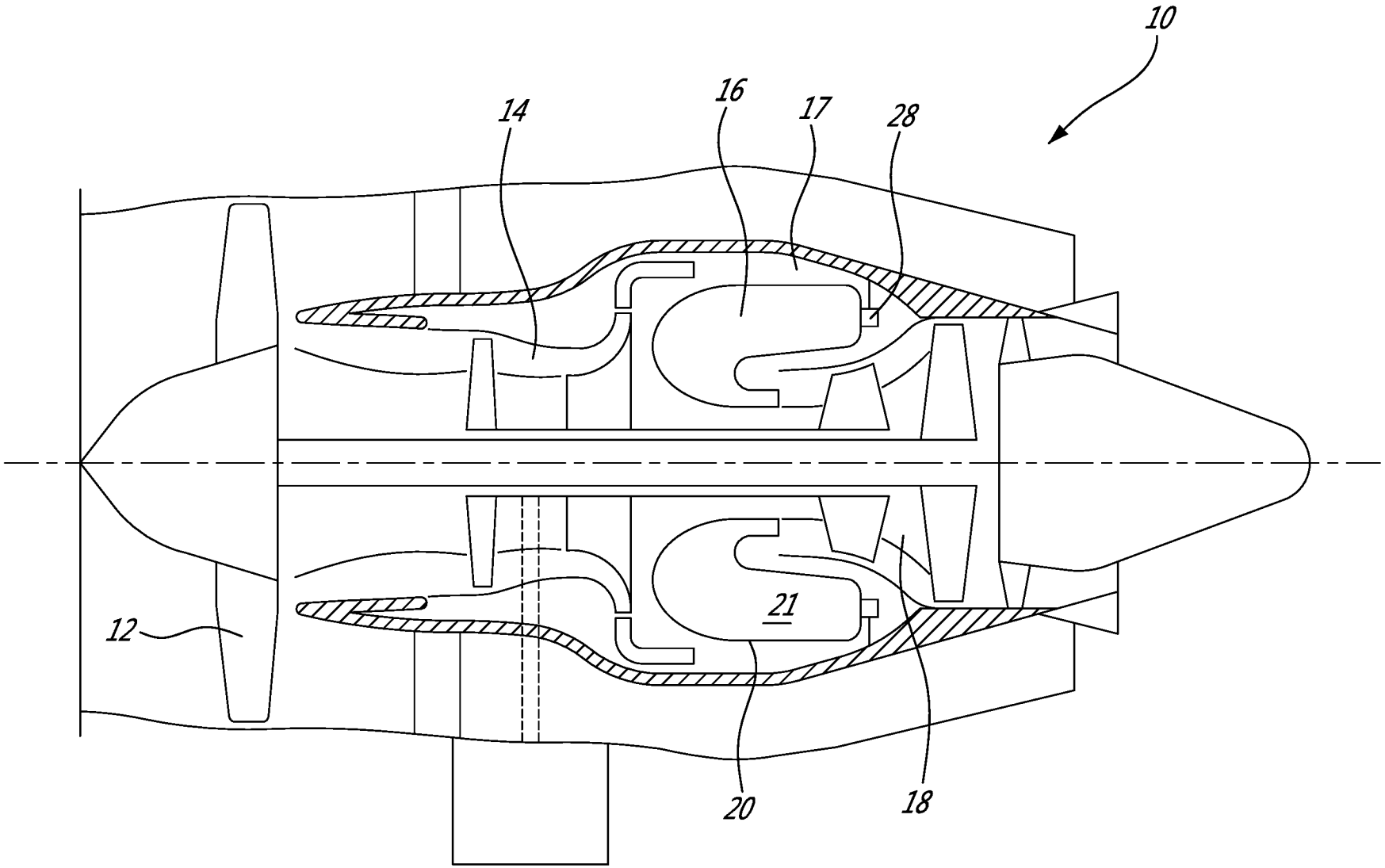
FIG. 1 is a schematic longitudinal sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

The combustor 16 is housed in a plenum 17 supplied with compressed air from the compressor 14. The combustor 16 comprises a combustor shell 20, typically formed by sheet metal inner and outer liners, defining a combustion chamber 21. A plurality of circumferentially spaced-apart fuel nozzles 28 (FIG. 1) are typically mounted in respective fuel nozzle openings 26 (FIGS. 2 to 4) defined in a dome 22 or bulkhead portion of the combustor shell 20.

Figure 2:
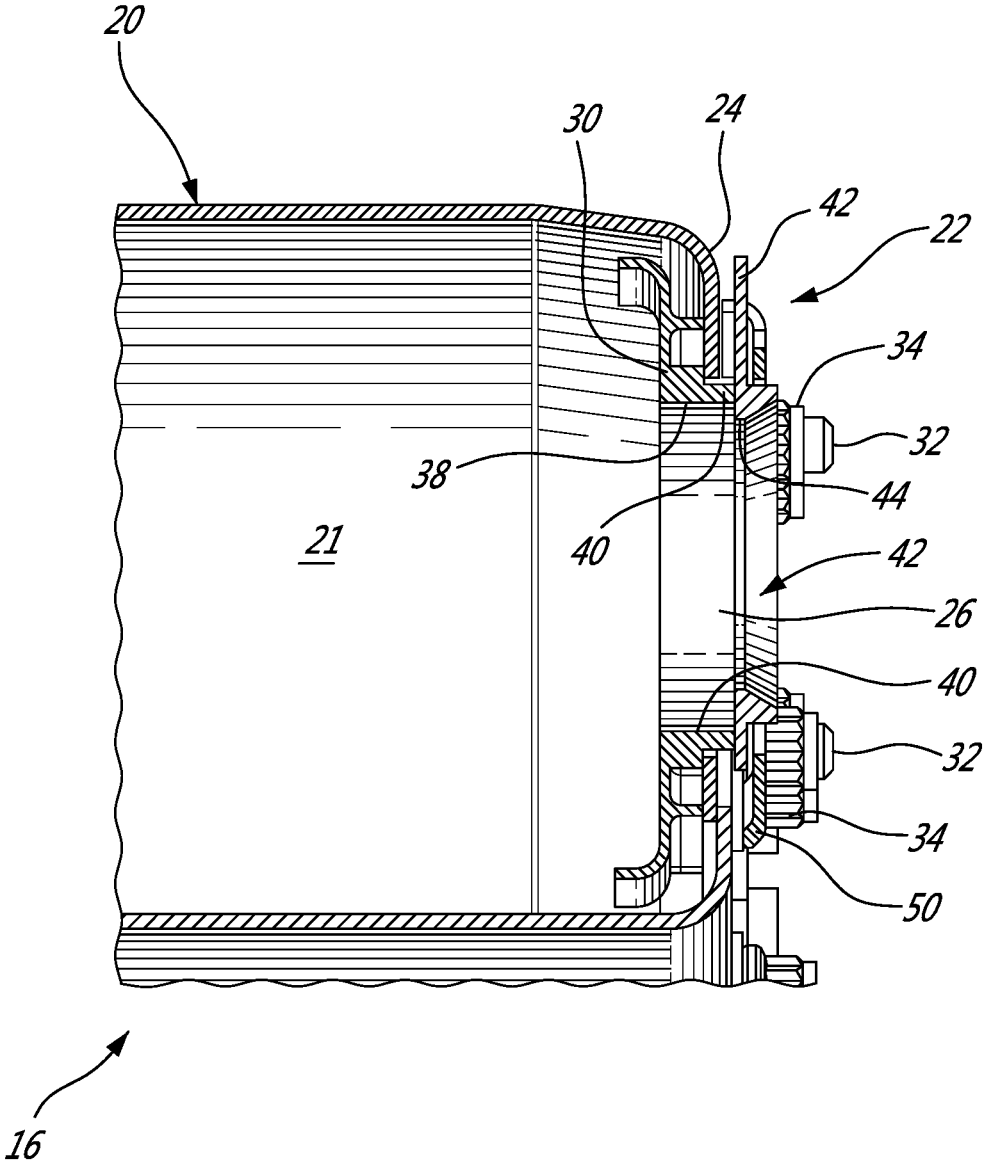
FIG. 2 is a partial sectional view of a combustor of the gas turbine engine showing a floating collar retained by an external retaining bracket mounted to heat shield studs outside of the combustor shell.
Figure 3:
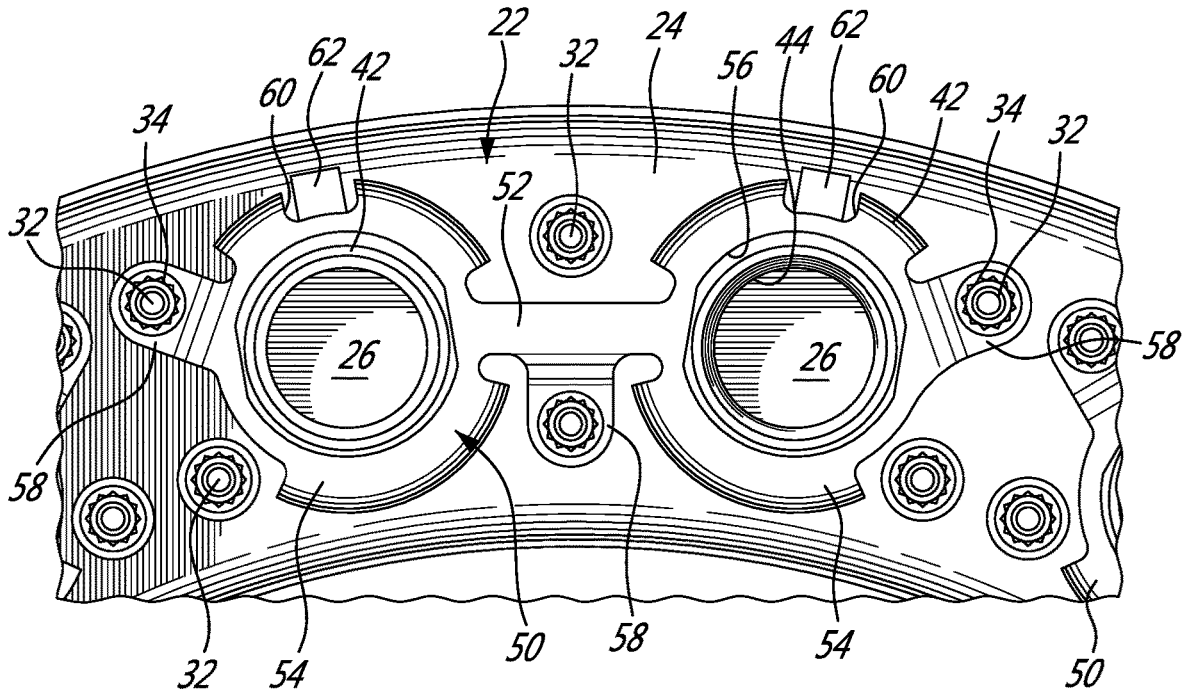
FIG. 3 is an end view from the cold side of the combustor showing the floating collar retaining bracket attached to the heat shield studs using existing heat shield studs and nuts.
Figure 4:
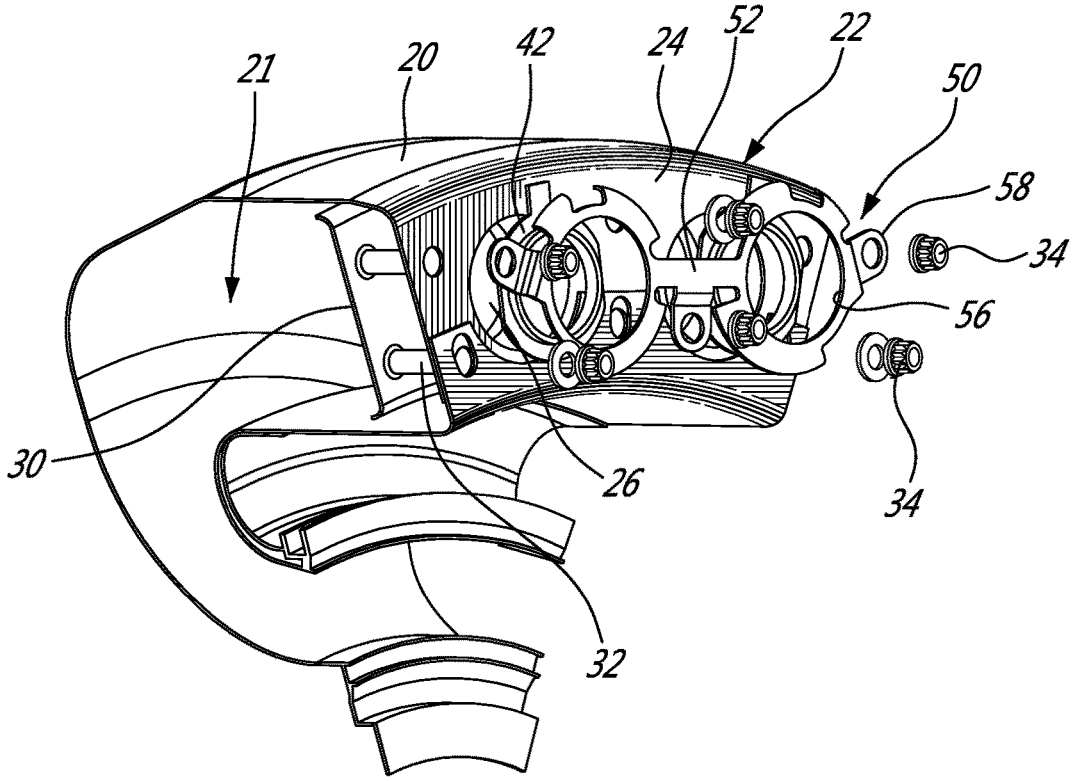
FIG. 4 is an exploded isometric view of the floating collar assembly.

Circumferentially distributed dome heat shields 30 (only one shown in FIGS. 2 and 4) are mounted inside the combustion chamber 21 to protect the dome 22 of the combustor shell 20 from the high temperatures in the combustion chamber 21. The dome heat shields 30 are typically castings made out of high temperature resisting materials. Referring concurrently to FIGS. 2 to 4, it can be appreciated that each dome heat shield 30 has a plurality of threaded studs 32 extending from a back face of the heat shield and through corresponding mounting holes defined in the combustor dome 22. Fasteners, such as self-locking nuts 34, are threadably engaged on the studs 32 from outside of the combustor shell 20 for holding the dome heat shields 30 tightly against the inner surface of the combustor dome 22.

Still referring to FIGS. 2 to 4, it can be appreciated that at least one fuel nozzle opening is defined in each of the dome heat shield 30. The heat shield fuel nozzle opening is aligned with a corresponding fuel nozzle opening 26 in the combustor dome 22 for accommodating an associated one of the fuel nozzles 28 therein. As shown in FIG. 2, the fuel nozzle opening is circumscribed by an inner annular rim 38 including an extended annular rail portion 40 extending from the back face of the heat shield 30 and configured to protrude outwardly from the combustor dome 22 through the fuel nozzle opening 26 when the heat shield 30 is mounted to the interior surface of the combustor dome 22.

Still referring to FIGS. 2 to 4, there will now be described an embodiment of a floating collar assembly suitable for permitting relative radial or lateral motion between the combustor shell 20 and the fuel nozzles 28 while minimizing leakage therebetween. According to the illustrated embodiment, the floating collar assembly comprises a floating collar 42 having an opening 44 in alignment with the corresponding registering openings in the dome heat shield 30 and the combustor dome 22 for receiving the associated fuel nozzle 28. As can be appreciated from FIG. 2, the floating collar 42 is mounted outside of the combustor shell 20 and has a front face in axial sealing contact with the extended rail 40 of the heat shield 30. The front face of the floating collar 42 is adapted for radial (relative to the engine axis of FIG. 1) sliding engagement with the extended rail 40 of the heat shield 30 outside the combustor shell 20. The opening 44 of the floating collar 42 is configured to axially (relative to the engine axis of FIG. 1) slidingly engage the body of the fuel nozzle 28 in order to effectively seal the combustor dome 22 from uncontrolled entry of compressed air from the plenum 17.

The floating collar 42 is axially retained in position by a retaining bracket 50 adapted to be mounted some of the studs 32 of the heat shields 30 as for instance shown in FIG. 3. The fasteners (e.g. the nuts 34) of the heat shields 30 can be used to secure the bracket 50 on the studs 32. As can be appreciated from FIG. 2, the floating collar 42 is axially sandwiched between the bracket 50 and the outer surface 24 of the combustor shell 20. In the illustrated embodiment, the bracket 50 is used to hold the floating collar 42 in abutment with the heat shield extended rail 40 protruding outside of the combustor dome 22. This method of supporting a fuel nozzle floating collar is different from traditional methods, in that the heat shield rail 40 protrudes past the combustor shell (i.e. outside of the combustion chamber 21), such that the floating collar 42 is located outside of the combustor shell 20. By moving the floating collar 42 to the outside of the combustor shell 20, the durability of the floating collar 42 can be improved due to lower thermal loading on the floating collar. It is understood that the floating collar 42 could be maintained in direct sealing engagement with the outer surface 24 of the combustor shell 20 or another external structure instead of an extended heat shield rail.

The retaining bracket 50 can adopt various configurations. In accordance with one particular embodiment shown in FIGS. 3 and 4, the bracket 50 is configured to span two circumferentially adjacent fuel nozzle openings 26 and, thus, two floating collars 42. More particularly, the bracket 50 can be provided in the form of a metal plate having a bridge 52 extending between two generally circular enlarged end portions 54, each end portion 54 defining a central opening 56 adapted to be mounted in registry with the registering holes of the heat shield 30, the combustor dome 22, and the floating collar 42. The bracket 50 has support tabs 58 (three in the illustrated example) for engagement with the studs 32 of the heat shields 30. Each tab 58 has a hole sized to receive one stud 32. The end portions 54 are provided with respective peripheral slots 60 for receiving the anti-rotation tabs 62 of the two floating collars 42 clamped between the heat shield extended rail 40 and the bracket 50, thereby individually limiting the amount by which floating collars 42 may rotate relative to the bracket 50 and, thus, the combustor shell 20.

In view of the foregoing, it can be appreciated that a given floating collar 42 may be assembled by first positioning the floating collar 42 so the opening 44 thereof is aligned with a corresponding dome opening 26 in the combustor dome 22, then engaging the bracket 50 on heat shield studs 32 projecting outwardly from the combustor dome 22, the floating collar being trapped between the combustor dome 22 and the bracket 50, and lastly engaging and tightening the nuts 34 on the studs 32.

In accordance with a general aspect of the present disclosure, there is provided a floating collar retaining feature whereby a retaining bracket is mounted outside of the combustor shell and secured thereto via existing heat shield studs and nuts. The bracket may be attached to as many studs as required to meet assembly and dynamic requirements.

According to another general aspect, there is provided a method of retaining a fuel nozzle floating collar comprising: using a retaining bracket outside of a combustor shell and attached to the combustor shell using existing combustor heat shield studs and nuts. By utilizing this type of mounting arrangement, the durability of the floating collar may be improved due to lower thermal loading on the floating collar in comparison to configurations where the floating collar is sandwiched between the combustor heat shield and combustor liner.

In addition, the above described mounting arrangement does not require joining operations such as welding or brazing, thereby reducing costs for the overall assembly. With the exemplified assembly procedure using the existing heat shield studs 32 and nuts 34, the floating collars 42 are readily accessible and removable/replaceable by simply removing the nuts 34.

The above description is meant to be exemplary only, and one skilled in the art will recognize that changes may be made to the embodiments described without departing from the scope of the invention disclosed. For example, the floating collar assembly could be used to accommodate an igniter instead of a fuel nozzle as described hereinabove. The size and shape of the two central openings 56 of the retaining bracket 50 could be optimized to accommodate variable floating collar float. Also, it is understood that the bracket size could be configured to support any number of floating collars per bracket. Furthermore, the number of support tabs 58 used to mount the retaining bracket 50 to the heat shield studs could be varied. Other modifications which fall within the scope of the present invention will be apparent to those skilled in the art, in light of a review of this disclosure, and such modifications are intended to fall within the equivalents accorded to the appended claims.

The invention claimed is:

1. A floating collar assembly for receiving a fuel nozzle or an igniter, the floating collar assembly comprising:

a first floating collar and a second floating collar configured for mounting outside a combustor shell extending along an axis, the first floating collar and the second floating collar spaced-apart in a circumferential direction around the axis of the combustor shell, the first floating collar and the second floating collar each having an opening configured and sized for alignment with an opening in the combustor shell, and a retaining bracket configured for mounting to studs extending outwardly of the combustor shell, the retaining bracket having a first enlarged end portion covering the first floating collar and a second enlarged end portion covering the second floating collar, the first enlarged end portion and the second enlarged end portion joined by a bridge, the first enlarged end portion defining a first opening in registry with the opening of the first floating collar, the second enlarged end portion defining a second opening in registry with the opening of the second floating collar, a first tab projecting from the first enlarged end portion on a side of the first floating collar opposite to the bridge in the circumferential direction, a second tab projecting from the second enlarged end portion on a side of the second floating collar opposite to the bridge in the circumferential direction, the first and second floating collars disposed between the first and second tabs in the circumferential direction, the first tab and the second tab each defining a hole configured to receive an associated one of the studs, the first floating collar and the second floating collar configured to be trapped between the combustor shell or another structure external to the combustor shell and the retaining bracket when the retaining bracket is mounted to the combustor shell.

2. The floating collar assembly defined in claim 1, wherein a third tab extends from the bridge of the retaining bracket, the third tab defining a hole configured to receive one of the studs.

3. The floating collar assembly defined in claim 1, wherein the first floating collar has a first anti-rotation tab engaged with a first slot defined in the first enlarged end portion of the retaining bracket, and wherein the second floating collar has a second anti-rotation tab engaged with a second slot defined in the second enlarged end portion of the retaining bracket.

4. A gas turbine engine combustor comprising: a combustor having a combustor shell circumscribing a combustion chamber extending along an axis, the combustor shell having a dome defining a plurality of nozzle openings spaced-apart along a circumferential direction around the axis for receiving a corresponding plurality of fuel nozzles, heat shields lining an inner surface of the dome, the heat shields having studs projecting through the combustor shell for engagement with corresponding fasteners outside the combustor shell, and a plurality of floating collars retained in position outside the dome of the combustor shell by a plurality of retaining brackets mounted to some of the studs of the heat shields and secured in position by the fasteners, each retaining bracket of the plurality of retaining brackets having first and second enlarged end portions respectively covering a first floating collar and a second floating collar of the plurality of floating collars, the first and second enlarged end portions joined by a bridge, the first enlarged end portion defining a first opening in registry with a corresponding opening in the first floating collar, the second enlarged end portion defining a second opening in registry with a corresponding opening in the second floating collar, a first tab projecting from the first enlarged end portion on a side of the first floating collar opposite to the bridge in the circumferential direction, a second tab projecting from the second enlarged end portion on a side of the second floating collar opposite to the bridge in the circumferential direction, the first tab and the second tab each defining a hole configured to receive an associated one of the studs on circumferentially opposite sides of the first and second floating collars.

5. The gas turbine engine combustor defined in claim 4, wherein the floating collars of the plurality of floating collars are abutted against an extended rail projecting from a back face of each of the heat shields through the plurality of nozzle openings to a location outside of the combustor shell.

6. The gas turbine engine combustor defined in claim 5, wherein the extended rail is annular and configured to surround an associated one of the plurality of fuel nozzles.

7. The gas turbine engine combustor defined in claim 4, wherein the first floating collar has a first anti-rotation tab engaged with a first slot defined in the first enlarged end portion of an associated one of the retaining brackets, and wherein the second floating collar has a second anti-rotation tab engaged with a second slot defined in the second enlarged end portion of the associated one of the retaining brackets.

8. The gas turbine engine combustor defined in claim 4, wherein a third tab projects from the bridge for engagement with another associated one of the studs.

* * * * *